US012654920B2

(12) United States Patent
Tekip et al.

(10) Patent No.: US 12,654,920 B2
(45) Date of Patent: Jun. 16, 2026

(54) PRODUCT CONTAINERS AND BUNDLES THEREOF, AND METHODS OF FORMING THE SAME

(71) Applicant: THE CLOROX COMPANY, Oakland, CA (US)

(72) Inventors: Theodore Tekip, Pleasanton, CA (US); Jessica Hamilton, Minneapolis, MN (US); Joerg Hendrix, Roswell, GA (US); James Martinek, Alpharetta, GA (US); Li Zhang, Pleasanton, CA (US); Timothy Mui, Boston, MA (US); Stephanie Gustafson, Pleasanton, CA (US); Ryan Brooks, Alpharetta, GA (US); Clayton Ohmes, Alpharetta, GA (US)

(73) Assignee: THE CLOROX COMPANY, Oakland, CA (US)

( * ) Notice: Subject to any disclaimer, the term of this patent is extended or adjusted under 35 U.S.C. 154(b) by 195 days.

(21) Appl. No.: 18/473,365

(22) Filed: Sep. 25, 2023

(65) Prior Publication Data

US 2024/0101326 A1 Mar. 28, 2024

Related U.S. Application Data

(60) Provisional application No. 63/410,348, filed on Sep. 27, 2022.

(51) Int. Cl.
*B65D 71/08* (2006.01)
*B65B 53/06* (2006.01)

(52) U.S. Cl.
CPC ..... *B65D 71/08* (2013.01); *B65B 53/06* (2013.01); *B65D 2571/00679* (2013.01)

(58) Field of Classification Search
CPC ..... B65D 71/08; B65D 2571/00679; B65D 71/10
USPC ..... 206/497; 220/23.2, 23.4, 23.83
See application file for complete search history.

(56) References Cited

U.S. PATENT DOCUMENTS

| | | | | |
|---|---|---|---|---|
| 3,836,044 | A * | 9/1974 | Tilp | B65D 83/0805 206/812 |
| 7,703,621 | B2 | 4/2010 | Evans et al. | |
| 8,196,372 | B2 | 6/2012 | Peri et al. | |
| 8,297,461 | B2 | 10/2012 | Evans et al. | |
| 8,439,195 | B2 | 5/2013 | Peri et al. | |
| 9,974,419 | B2 | 5/2018 | Azelton et al. | |
| 10,039,425 | B2 | 8/2018 | Azelton et al. | |
| 10,327,602 | B2 | 6/2019 | Azelton et al. | |

(Continued)

FOREIGN PATENT DOCUMENTS

| | | | |
|---|---|---|---|
| DE | 102016116737 | A1 | 3/2018 |
| GB | 2216864 | A | 10/1989 |
| WO | 2007/025165 | A1 | 3/2007 |

OTHER PUBLICATIONS

International Search Report and Written Opinion dated Feb. 13, 2024 in PCT/US2023/075068, 15 pages.

*Primary Examiner* — Steven A. Reynolds
(74) *Attorney, Agent, or Firm* — Edell, Shapiro & Finnan, LLC

(57) ABSTRACT

A product container made of a certain plastic material, and the coupling of multiple such product containers together are disclosed herein. Each of the product containers includes either a solid or a solid/liquid combination product therein, which impacts the process of coupling the product containers.

20 Claims, 10 Drawing Sheets

(56) References Cited

U.S. PATENT DOCUMENTS

| | | | | |
|---|---|---|---|---|
| 2001/0008240 | A1 | 7/2001 | Herrin | |
| 2003/0155266 | A1* | 8/2003 | Andersen | B65D 71/10 206/427 |
| 2004/0188305 | A1* | 9/2004 | Bansal | B65D 5/28 206/427 |
| 2004/0198893 | A1* | 10/2004 | Nelson | C08L 81/06 524/502 |
| 2007/0080087 | A1* | 4/2007 | Lentner | B65D 5/2038 206/497 |
| 2012/0234712 | A1* | 9/2012 | Moore | B65D 71/02 206/391 |
| 2020/0405102 | A1 | 12/2020 | Azelton et al. | |
| 2021/0214116 | A1* | 7/2021 | Palmer | B65D 1/023 |

* cited by examiner

PRODUCT CONTAINERS AND BUNDLES THEREOF, AND METHODS OF FORMING THE SAME

RELATED APPLICATION

This application claims priority to and the benefit of U.S. Patent Application Ser. No. 63/410,348, filed Sep. 27, 2022, entitled "Product Containers and Bundles Thereof, and Methods of Forming the Same," the disclosure of which is incorporated by reference herein in its entirety for all purposes.

FIELD OF THE INVENTION

The present invention is directed generally to a product container or canister, and more specifically, to a bundle of product containers or canisters.

BACKGROUND

Containers that have a product therein are well known. Typically, a container with a product therein can be coupled to a similar product container for ease of handling for transportation and storage. Sometimes a plastic film is utilized to couple multiple product containers together.

In some processes, the product containers and the plastic film are subject to heat to activate the plastic film so that it shrinks around part of the product containers to couple them together. Sometimes, the heat causes deformation in the product containers depending on the material used for the product containers, and the thickness of the material.

SUMMARY

The present invention relates to a product container made of a certain material, and the coupling of multiple such product containers together. In different embodiments, the nature of the product in the container can vary. In one embodiment, each of the product containers includes a solid/liquid combination product therein, which impacts the process of coupling the product containers. A solid/liquid combination product is a product that includes has a solid or non-liquid component as well as a liquid component. In one embodiment, the solid/liquid combination product is mostly a solid product.

The product containers are coupled together via a coupler. In one embodiment, the coupler is a plastic film or plastic wrap that can be activated via the application of heat. The plastic film shrinks and holds the product containers together. The application of heat on the product containers can potentially damage them. The extent of such damage varies depending on the temperature of the applied heat, the material of the containers, the thickness of the containers, and what product is in the containers when the heat is applied. Accordingly, the damage can be minimized in part by selecting a stronger material for the containers, and/or by increasing the thickness of the containers in certain areas that often experience deformation.

The present invention also relates to environmental, social, and governance (ESG) goals relating to the use of plastic in products. One ESG goal is to reduce the amount of single-use plastic in product containers. Another ESG goal is to reduce the overall amount of plastic used in product containers.

The present invention contemplates reducing the amount of single-use plastic in containers by increasing the amount of additives in the material used to form the container body. Some additives are included in post-consumer recycled (PCR) material that is used to manufacture the container. The amount of additives, such as pigments, colorants, strengthening agents, plasticizers, stabilizers, and lubricants, as well as the amount of PCR material which can also contain additives, that can be used in a container while maintaining the structural integrity of the container depends on the particular plastic. In one embodiment of the invention, the containers are made of polyethylene terephthalate (PET), which has properties that allow more than 25% additive material to be used in the container without losing the strength properties of the container. Other plastic materials, such as high-density polyethylene (HDPE), have structural limitations that do not allow more than 25% additive material to be used. For those plastic materials, more than 25% additive material will negatively impact the structural integrity of the container and as a result, additional plastic material will be needed.

The present invention also contemplates reducing the amount of plastic used in a product container by selecting a stronger plastic material so less plastic material overall is needed for the container. Certain areas of the container can have increased thickness that strengthen those areas that are normally subject to more stress and deformation.

The present invention relates to a combination of container properties (including the material used to make the container), heat shrink tunnel parameters (including temperature and time), and the plastic film used to couple multiple containers together.

In one implementation, a packaged product comprises a first container and a second container, each of the first container and the second container having a side wall, the first container being made of polyethylene terephthalate (PET) and having a minimum wall thickness between 0.003 inches and 0.09 inches, the first container having a product therein, and a plastic film coupling the first container and the second container together, wherein heat energy is applied to the plastic film to couple it to the first container and the second container.

In one aspect, the minimum wall thickness of the first container is between 0.005 inches and 0.02 inches. In another aspect, the minimum wall thickness of the first container is between 0.009 inches and 0.02 inches. In yet another aspect, the minimum wall thickness of the first container is between 0.01 inches and 0.02 inches.

In one aspect, the first container has at least 25% of its material being additive material, and the additive material includes post-consumer recycled (PCR) material, colorants and/or strengthening agents. In another aspect, the product in first container includes free liquid within the first container, and the free liquid directly engages less than 5% of a length of the side wall of the first container. In yet another aspect, the product in the first container is a solid/liquid combination product that has less than 85% liquid by volume, and the free liquid in the solid/liquid combination product directly engages less than 5% of the length of the side wall of the first container. In a further aspect, the solid/liquid combination product has less than 85% liquid by volume. Alternatively, the solid/liquid combination product includes substrates and an aqueous solution saturating at least part of the substrates, the aqueous solution being one of a sanitizing liquid or a disinfecting liquid.

In one aspect, the product in the first container is a solid product. In another aspect, the packaged product further comprises a tray disposed between a portion of each of the first container and the second container and the plastic film.

In another implementation, a product comprises a plurality of containers, each of the containers having a minimum wall thickness between 0.003 inches and 0.09 inches, each of the containers being made of PET and having a product therein with at least a portion of the product in direct contact with a portion of a side wall for the container, and a coupler activatable by heat energy to shrink around portions of the plurality of containers, wherein heat energy is applied to the coupler so that it shrinks.

In one aspect, the minimum wall thickness of a first container of the plurality of containers is between 0.005 inches and 0.02 inches. In another aspect, the first container of the plurality of containers has at least 25% of its material being additive material, and the additive material includes PCR material, colorants and/or strengthening agents. In yet another aspect, the product in each container directly engages less than 5% of a length of the side wall of that container. In a further aspect, the product in each container is a solid/liquid combination product that has less than 85% liquid by volume. Alternatively, the solid/liquid combination product includes substrates and an aqueous solution saturating at least part of the substrates, the aqueous solution being one of a sanitizing liquid or a disinfecting liquid. In another aspect, the product in each container is a solid product.

In another implementation, a method of manufacturing a product that includes a first container made of PET material and a second container made of PET material, each of the first container and the second container including a side wall having a minimum wall thickness between 0.003 inches and 0.09 inches, each of the first container and the second container including a product therein, with the method comprising the steps of forming the first container and the second container via blow molding the PET material, placing the first container and the second container proximate to each other, placing a coupler around a portion of the first container and a portion of the second container, and activating the coupler so that the coupler secures the first container and the second container together, wherein the coupler is activated at a temperature between 50 degrees Celsius and 300 degrees Celsius, and the coupler is activated by infrared (IR), ultraviolet (UV), hot air, or steam.

In one aspect, the product in each of the first container and the second container is either a solid product or a solid/liquid combination product, and a majority of each of the first container and the second container is not engaged by a respective product therein during the activating the coupler step.

DETAILED DESCRIPTION

Figure 1:
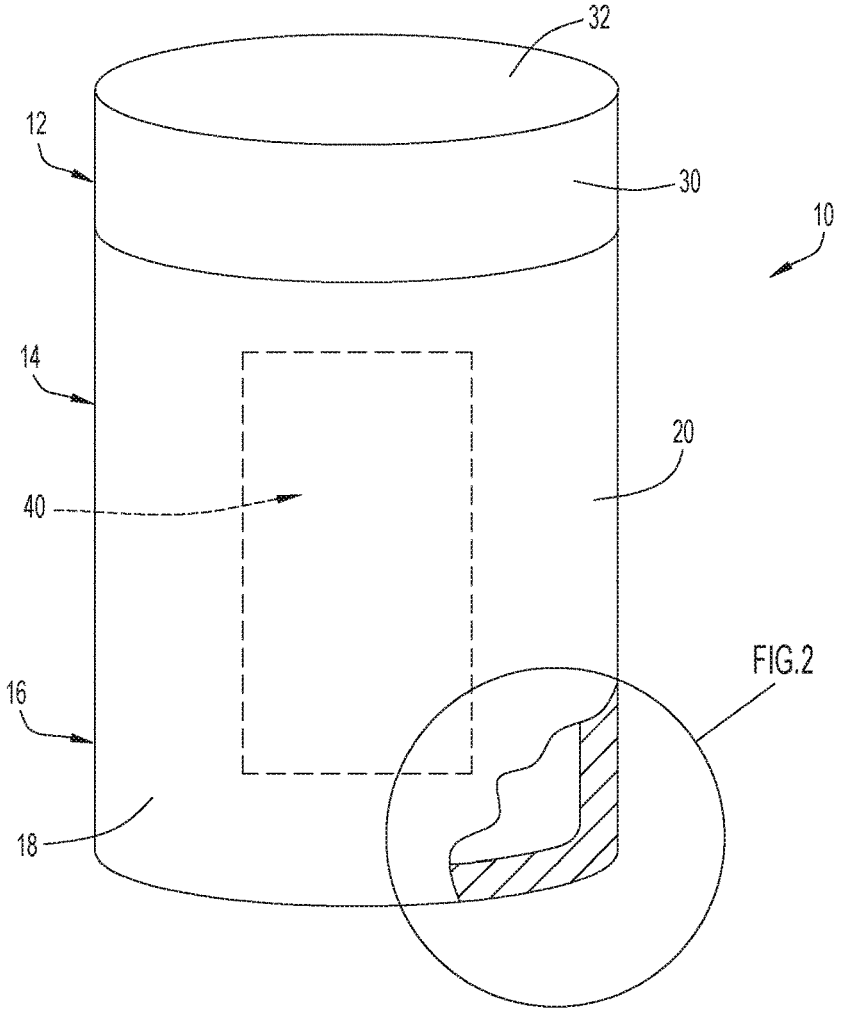
FIG. 1 is a perspective view of a container according to an embodiment of the invention.

The present invention is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention relates to the creation of multipacks or bundles of containers or canisters that have product therein. In one embodiment, the containers are made of PET, which reduces the amount of plastic needed for the container relative to other types of plastic materials, because PET maintains its strength and resilience to deformation due to heat and/or loads applied thereto.

Deformation of containers occurs during the manufacturing process when multiple containers are bundled together via a coupler. In one embodiment, the coupler is a plastic film. Either a single container or multiple containers are placed proximate to each other and a film is placed loosely around a portion of the container or containers. The discussion herein of containers can be applied to a single container as well.

In alternative embodiments, the containers can be placed on a tray made from any material that shields heat sufficiently, including a paperboard or a corrugated material. The tray can have a variety of shapes that facilitate the tray having one or more portions proximate to the bottom surface and/or the side walls of the containers (also referred to as container walls). If a tray is utilized, the film is placed loosely around the containers and the tray as well.

The containers and tray, if present, with the film therearound are then placed into a shrink tunnel or heat tunnel that utilizes a conveyor to move the containers therethrough.

The heat tunnel can use any one of a variety of heat sources to apply heat the film, thereby activating it and causing it to shrink around the containers. Some exemplary heat sources are infrared (IR), ultraviolet (UV), steam, hot air, or other sources of energy. If present, the tray functions as a shield that protects a portion of the containers from the applied heat energy. However, utilizing a tray does increase the overall amount of material used for a package of containers.

The applied heat energy can cause deformation in the containers. In particular, the applied heat is absorbed by the container walls, which can result in deformation thereof, depending on the amount of heat absorbed. The impact of the absorption on the deformation of the container is determined by several factors. A first factor is the material used for the container body. By utilizing a specific plastic material, such as PET, that has greater strength properties, for the material of the container, the container can withstand the application of heat better than other materials. As discussed herein, a container made from PET can be made with thinner walls, resulting in less plastic material being used per container. In addition, the strength of PET as the material for the container enables various additives to be present in the container material without a loss of strength. A PET material container can maintain its strength and include more additives, which can be added originally to the PET material or originate from PCR materials used with PET material to form the container. The recyclability is impacted by the amount of additives present in a material.

A second factor is that the thickness of the container wall impacts the amount of deformation due to the heat. As the container wall becomes thicker, the ability of the wall to absorb heat without deforming increases. There is a trade-off with respect to wall thickness. To reduce the amount of deformation during the film shrinking process, the container walls can be made thicker. However, increasing the thickness increases the amount of plastic material used in each container, thereby costing more money and utilizing more plastic, both of which are not desirable. Thus, utilizing a specific plastic material, such as PET, that has properties enabling it to withstand the application of heat with a thinner container wall than other plastic materials results in less plastic material being used per container.

A third factor is the type of container. In one embodiment, the container includes a body defining a receptacle and a lid coupled to the body that controls access to the receptacle. The body can receive a product that is selectively withdrawn from the container through the lid. In this embodiment, the body formed by blow-molding and the lid is formed by injection molding. As a result, the lid is stiffer and less flexible than the container body, and thus has less give when compared to the container body. When the lid is coupled to the upper end of the container body, the lid forms a tight connection or seal therewith to preserve the contents in the container. The lid forces the container body or wall slightly inwardly when it is mounted thereon and remains coupled thereto with a slight inward force. That force creates a stress on the lower end of the container body or wall near the heel of the container, and any other location with the thinnest wall thickness of the container. This added stress increases the potential for deformation in the stressed area when heat is applied to the container.

In one or more embodiments, the container can be a canister in which disinfecting wipes are contained. Some canisters with lids as discussed above are described in U.S. Pat. Nos. 7,703,621; 8,297,461; 9,974,419; 10,039,425; and 10,327,602, and in U.S. Patent Application Publication No. 2020/0405102, the disclosures of each of which are incorporated herein by reference in their entirety.

A fourth factor is whether a tray is used during the coupler shrinking process, and the positioning of the tray relative to any container or containers. As discussed above, a tray shields any portion of the containers to which the tray is proximate as the heat energy is applied to activate and shrink the coupler around the containers and tray.

The bundles of product containers according to the invention is determined by a combination of factors that include the material and dimensions of the container holding the product, the type and properties of the film used to bundle containers, the product in the containers, and the shrink tunnel optimization of temperature and time.

Figure 2:
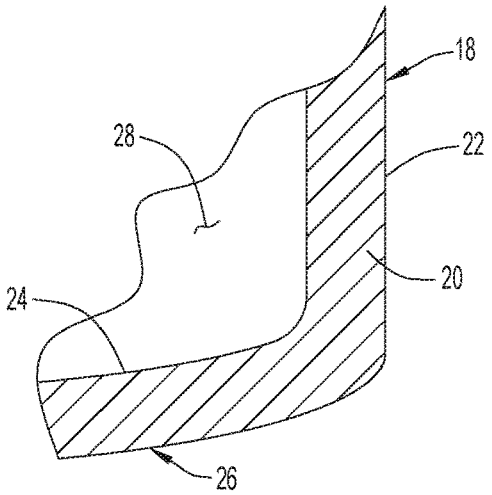
FIG. 2 is a close-up perspective view of a portion of container in FIG. 1 with part of a side wall removed.

Referring now to FIGS. 1 and 2, a container or canister 10 according to the invention is shown. FIG. 1 illustrates a perspective view of an embodiment of the container 10, and FIG. 2 illustrates a close-up partial cross-sectional view of part of the container 10. Container 10 can be referred to alternatively as a container or canister.

Container 10 includes a top portion 12, a body or panel portion 14, and a bottom portion 16. The container 10 also includes a wall or side wall 20 that defines an interior chamber or region 28 in which a product 40 is located. The side wall 20 can be referred to alternatively as a wall or a container wall or container body. A lid portion 30 with a reclosable flap 32 can be coupled to the top portion 12 and used to control access to the product 40. As shown in FIG. 2, the wall 20 includes an outer surface 22 and an inner surface 24 between which is the thickness of the wall 20. The wall 20 also has a bottom or lower surface 26. A product label (not shown) can be attached to the outer surface 22.

Part of the bottom portion 16 of the container 10 is referred to as a heel 18. In one embodiment, the heel 18 is roughly designated as the part of the container 10 that extends approximately one inch (1") up from the container lower surface 26 and approximately one inch (1") along the lower surface 26 toward the middle of the lower surface 26.

Figure 3:
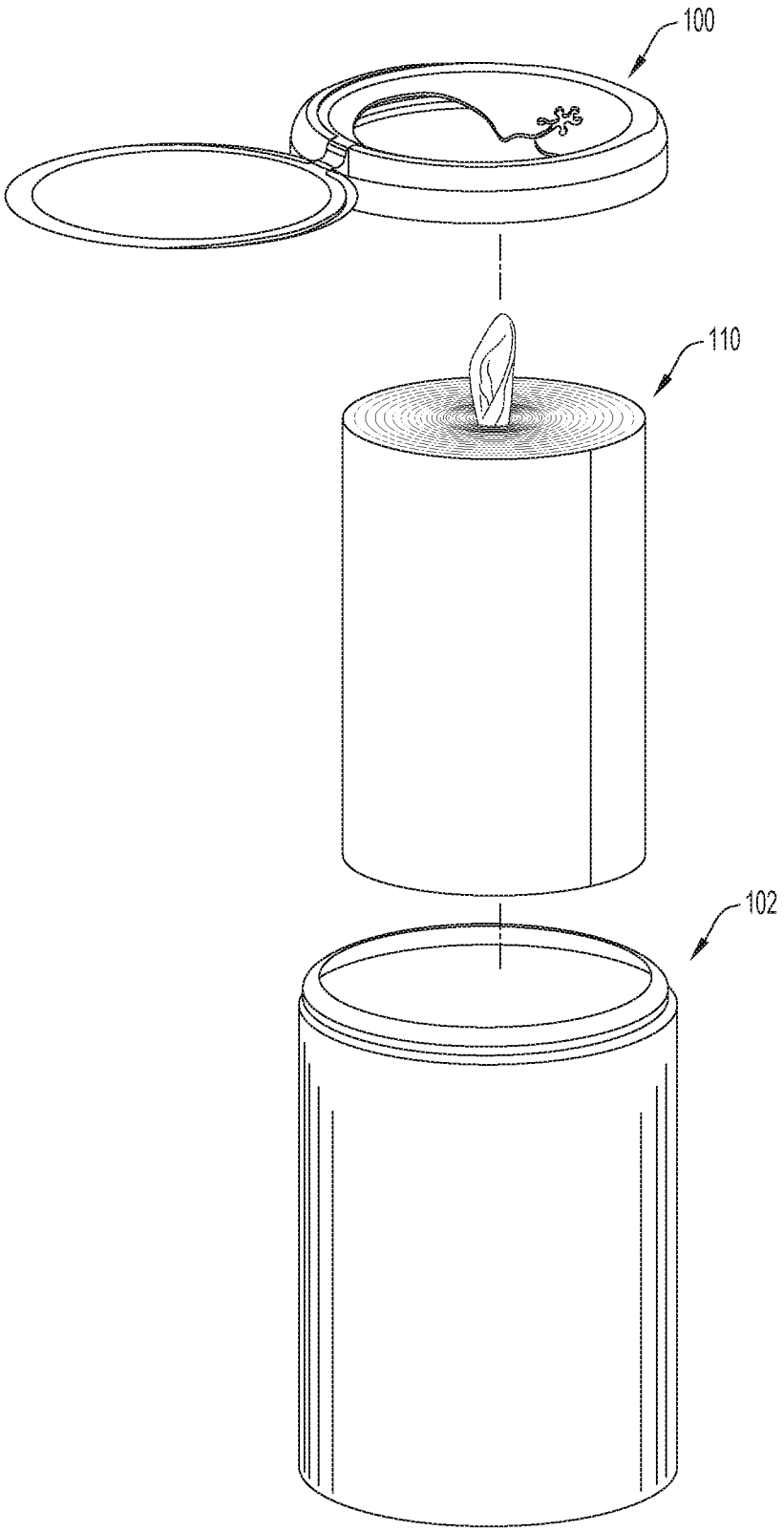
FIG. 3 is an exploded perspective view of a container and a product.

Referring to FIG. 3, an exemplary lid 100 and container body 102 are illustrated. The lid 100 is illustrative of a lid that could be used with container body 102. Container body 102 is sized to receive product 110, which in this embodiment are wipes 110 wound in the shape of a donut. In FIG. 3, the donut of wipes 110 is illustrated in an exploded perspective position from container body 102 and removable lid 100.

Figure 4:
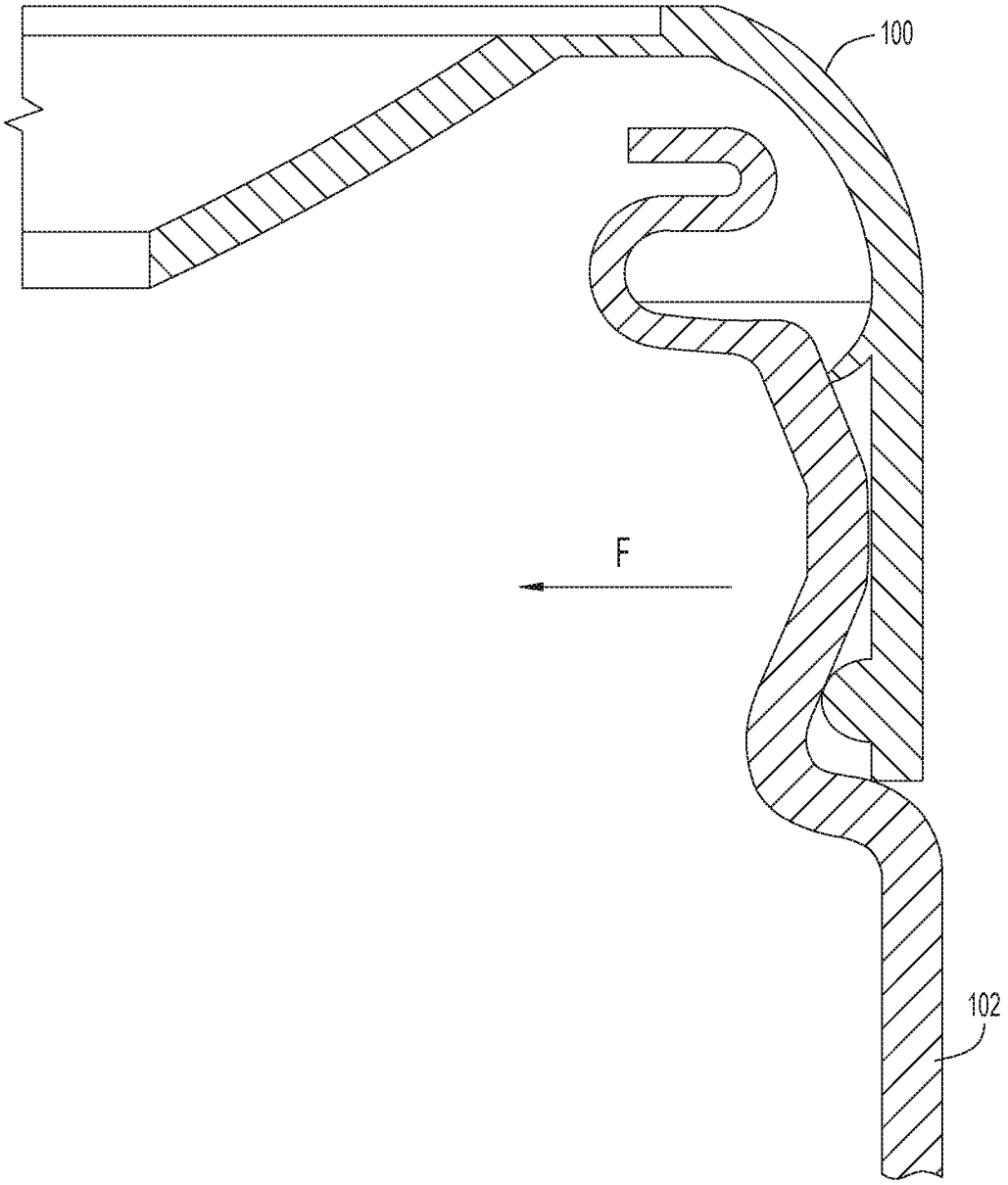
FIG. 4 is a close-up cross-sectional view of a portion of the container of FIG. 3.

Referring to FIG. 4, an exemplary interaction of part of the lid 100 and part of the container body 102 is illustrated. In this embodiment, lid 100 is formed by injection molding and container body 102 is formed by blow molding. When the lid 100 is snapped onto the upper end of the container body 102, a force along the direction of arrow "F" is applied inwardly to the container body 102. A resulting stress is generated in the lower end of the container body 102 near the heel when force "F" is applied to the container body 102. As discussed above, the stress in the heel increases the potential for deformation of the container body 102 near the heel.

Figure 5:
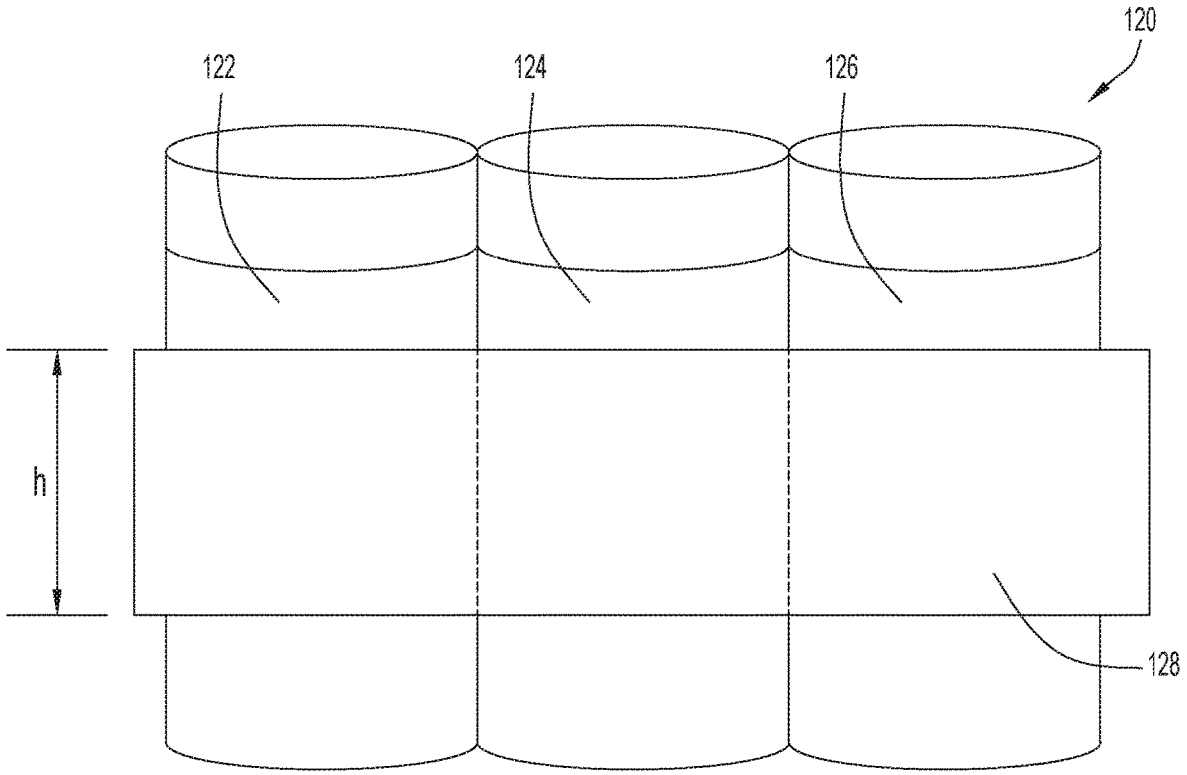
FIG. 5 is a front view of several containers coupled together according to an embodiment of the invention.

Referring to FIG. 5, a bundle 120 of containers is shown. While bundle 120 is illustrated as having three containers, in other embodiments, a bundle may contain a single container or a bundle can have two or more containers. For example, in one embodiment, the bundle 120 can include between two and at least twenty-four containers. The quantity of containers is limited only by the mechanism used to heat shrink the coupler onto the container or containers.

Containers 122, 124, and 126 can be coupled together via coupler 128. In one embodiment, the coupler 128 is a plastic film that is placed around one or more containers 122, 124, and 126. Heat is applied to the coupler 128, by any one of several ways to apply heat, which catalyzes the film to shrink tightly around the one or more containers 122, 124, and 126, thereby coupling them together. The heat can be applied by via IR, UV, steam, hot air, or other sources of energy using a conveyor heat tunnel or shrink tunnel or using an electric or gas heat gun. The plastic film is a low melting plastic film. In various embodiments, the film can be made of PET, HDPE or polyethylene (PE). In one embodiment, to balance cost and/or reduce material, preferably the film shrinks in both the machine direction (MD) and the cross direction (CD). The ratio of shrinkage in the MD vs. the CD can vary in different embodiments.

There are multiple benefits to using a lower gauge film as the coupler to bundle containers together. One benefit is to minimize the amount of film material used in each bundle. In one embodiment, the film has a gauge or thickness between 1.5 mm and 1.75 mm. By using a lower gauge film, the film has a lower shrink activation temperature, which facilitates the second benefit of using a lower temperature in the heat tunnel, thereby subjecting the containers to less heat. In one embodiment, a film with a shrink activation temperature between 50 degrees and 300 degrees Celsius is used to form a bundle of PET containers made with more than 25% additive material. The film is activated using a heat tunnel at a temperature between 50 and 300 degrees Celsius.

The glass transition temperature of HDPE material is 130 degrees C., and the glass transition temperature of PET material is 70 degrees C. The higher glass transition temperature of PET material relative to HDPE material allows a higher temperature to be used in the film activation process. Several resulting benefits are: PET can be used instead of HDPE to form the container as it can withstand higher temperature without deformation; the higher temperature decreases the time it takes to activate the film, thereby improving the process; and a wider variety of films can be used because a higher temperature is possible in the heat tunnel using a PET material instead of a HDPE material for the container.

As mentioned above, a shrink tunnel (not shown) is used to heat the coupler 128 so that it forms around the containers. In different embodiments, the height "h" of the coupler 128 can vary and in some instances wrap around the tops and ends of the containers 122, 124, and 126.

Figure 6:
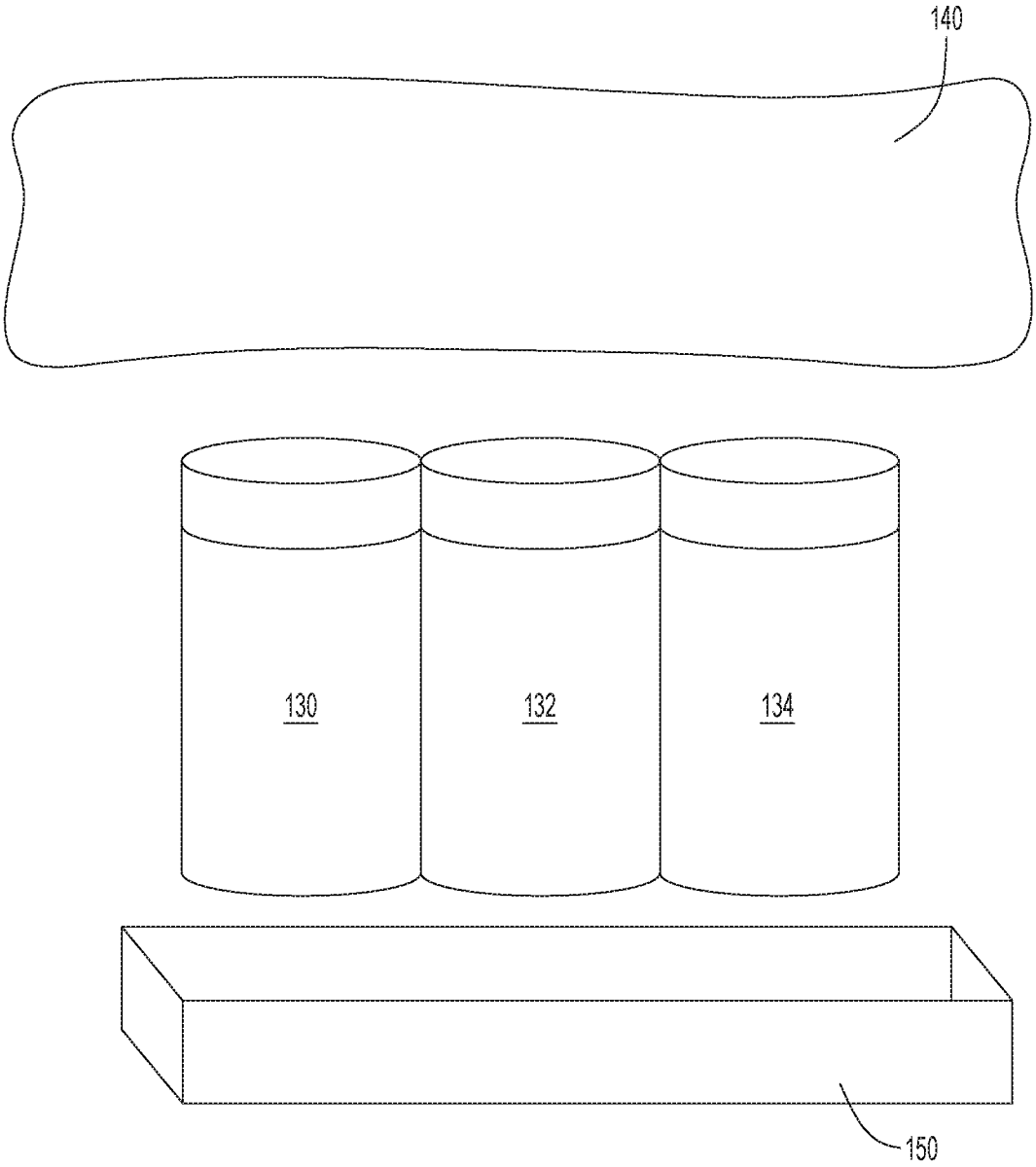
FIG. 6 is a front view of another set of containers prior to being coupled together according to an embodiment of the invention.

Referring to FIG. 6, an optional tray or boot 150 is illustrated on which the containers 130, 132, and 134 may be placed before a coupler 140, such as a plastic film, is wrapped around the containers and tray before being processed in the shrink tunnel.

The shrink tunnel process can be optimized by adjusting the temperature of the heat applied to the containers and plastic film, as well as the amount of time that the containers and plastic film are subjected to the heat. Each of an increase in heat temperature and a lengthening of the heat application is a factor that impacts the amount of deformation in the product containers.

Figure 7:
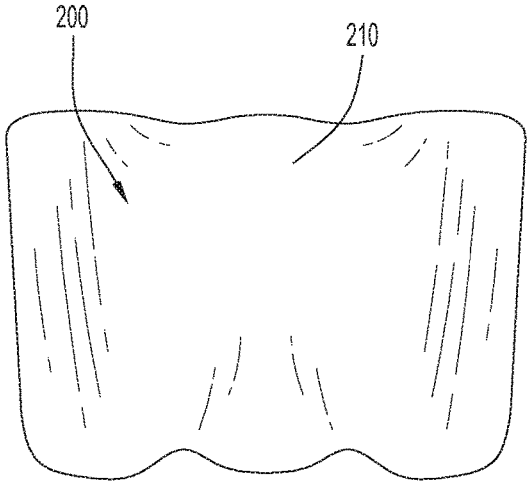
FIGS. 7 and 8 are a front view and an end view, respectively, of several containers coupled together according to an embodiment of the invention.
Figure 8:
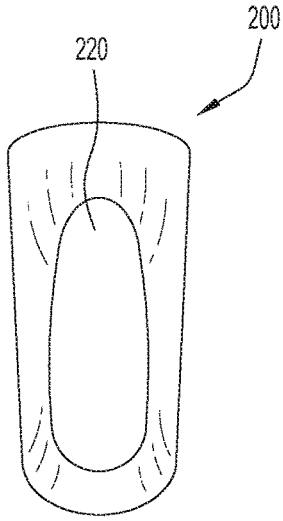

Referring to FIGS. 7 and 8, a bundle 200 of containers is shown. In this bundle, coupler 210 extends around the upper and lower portions of the containers as well as the sides of the end containers, such as container 220.

When the containers and the coupler are placed in a shrink tunnel, they are subject to heat that activates the coupler. The temperature of the heat is determined by the activation temperature of the coupler. In some instances, the containers and coupler, such as a plastic film, are subject to heat between 50 and 300 degrees Celsius. While the heat activates the plastic film and causes it to shrink, it also can impart damage to the containers.

In addition, when bundled containers are placed atop each other, a force is applied to the tops of any lower bundles. Depending on the material used for the lower bundled containers, the strength of them can vary and they may suffer damage, such as denting or sagging. As discussed above, the amount of damage from heat and/or a load applied to the bundle of containers is determined by a few factors.

First, the thickness of the container side wall is a factor. As the thickness of the side wall increases, the side wall is more stable and deforms less when subject to heat or a vertical load. While increasing the thickness of the side wall is a solution to overcoming deformation, the trade-off is that the additional material increases the costs per container and the increased plastic in the container runs counter to any goals relating to less plastic material being used and consumed.

Second, there is a constant effort to reduce the amount of single-use plastic materials used in products. To achieve such a reduction, it is desirous to include additives and/or PCR material in products, which results in more additive material being used in the product. The amount of additive material in a product affects its structural integrity, and may have a significant impact, depending on the particular plastic material used in the product. Ideally, one wants to utilize as much PCR as possible, which possibly increases the amount of additives present, without negatively impacting the structural integrity of the product too much.

Third, the particular material used for the container side wall is also a factor. Current containers are made using HDPE. For an HDPE container, there is a limit on how much additive and/or PCR materials can be used due to the weakness of HDPE. In particular, the container of a certain size and shape can only have approximately 25% of its material be PCR due to the weakness of HDPE. Once HDPE containers have more than 25% PCR material with the current amounts of plastic, it loses integrity and deforms due to applied heat and/or loads. For example, a container will dent when a certain amount of weight is applied in a top-load or dynamic vertical load (DVL) testing. In order to have a higher % of PCR materials in an HDPE container, more HDPE material is needed, thereby increasing the overall amount of plastic material used and increasing the cost of the product container.

In the present invention, it was discovered that containers made of PET can be up to 100% PCR material and still maintain their structural integrity when a load is applied or the containers are subjected to heat as compared to a HDPE container with 25% PCR material. In one embodiment of the invention, containers made of PET may contain 50% PCR materials and retain their strength with minimal damage. Due to the nature of PET material, a container made from PET is stronger than a similarly sized HDPE container.

Two rounds of tests were conducted using HDPE containers and PET containers, with the containers in each round having a different thickness. In the first round, an equivalent strength between a HDPE container incorporating 25% PCR material and a PET container incorporating 100% PCR material was determined for a wall thickness of 85 mm. The amount of HDPE with 25% PCR needed was 45 grams, while the same strength container made of PET with between 25%-100% PCR was 35 grams. In other words, 10 grams less of material is needed when PET is used instead of HDPE.

Similarly, in the second round of testing, each of the HDPE and PET containers was made with a 100 mm wall thickness. In this test, the HDPE with 25% PCR container used 60 grams of material, and the PET with between 25% and 100% PCR only used 45 grams of material to have the same strength. Accordingly, less material is needed using PET instead of HDPE to provide the same strength container. In addition, a higher percentage of PCR can be used in the PET container.

Another relevant factor of a product is its weight, which impacts the costs of transporting and storing the product. PET canisters are approximately 25% lighter than HDPE containers because less plastic is used in the PET containers. As a result, cost savings are achieved due to reduced material costs and shipping costs.

Figure 9:
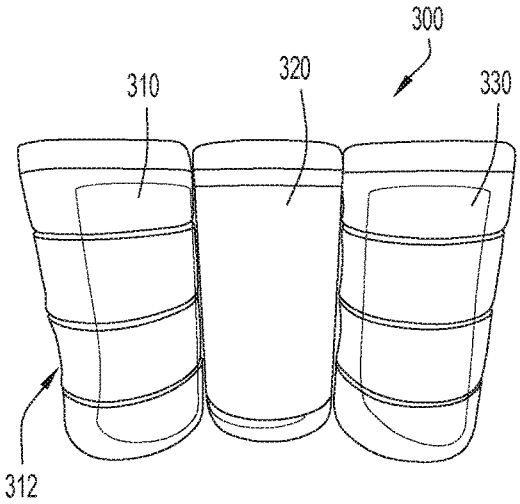
FIG. 9 is a perspective view of several containers that were coupled together and heat applied thereto, and now with the coupler removed.
Figure 10:
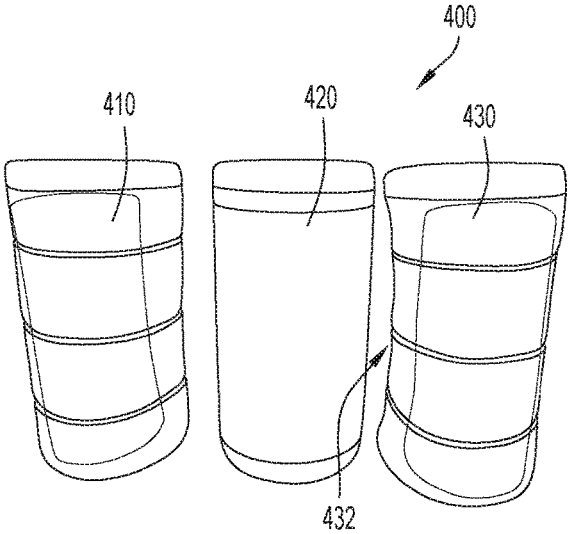
FIG. 10 is a perspective view of several containers that have been coupled together and heat applied thereto, and now with the coupler removed.

Another important factor is the product that is located in the container. Referring to FIGS. 9 and 10, two views of canisters containing donuts of wipes are illustrated. In FIG. 9, the group or bundle 300 of containers 310, 320, and 330 has been through the plastic film heat shrink process and the plastic film has been removed. Mild deformation can be seen on in the side wall 312 of container 310. Due to the positions of the containers during the heat shrink process, it is often the containers at the ends of a bundle that experience more heat deformation than containers in the middle of the bundle.

In FIG. 10, similarly, the group or bundle 400 of containers 410, 420, and 430 has been through the plastic film heat shrink process and the plastic film has been removed. Side wall 432 of container 430 has severe deformation, which is along the entire side of container 430 from its top portion to its bottom portion. Side wall 432 was facing outward during the heating process, and has been rotated so that it is now proximate to the middle container 420.

As discussed above, during the shrink tunnel process, heat is applied to the container (and any product therein) and to the coupler or plastic film. When the container includes a liquid product, such as a soft drink or water, the liquid product acts as a heat sink and absorbs heat that is applied during the plastic film activation process. By the liquid absorbing heat, the material of the container has to process and absorb less heat overall, thereby reducing the amount of deformation of the container.

As the contents of a container absorb less applied heat, the amount of container deformation increases. Thus, at the same temperature, an all-liquid contents container will have to absorb less heat than a container containing a mixture of liquid and solids. Thus, less material is needed for the side wall of the container of an all-liquid contents container to reduce the deformation thereof. That results in cost savings.

Two points relating to the heat absorption by the product in the container are: how much of the product is in contact with the container body or wall; and what type of product is in the container. When a combination solid and liquid product is in the container, such as in one embodiment of this invention, the heat absorption by the contents is less than an all-liquid contents container. In one embodiment of the invention, the contents can be a solid/liquid or solid and liquid combination, such as a wipes product that includes a solid, flexible substrate and a liquid that has saturated at least part of the substrate, and in some instances, the entire substrate or solid product. In one embodiment, the liquid can be an aqueous solution, such as either a sanitizing solution or a disinfecting solution. Due to the presence of the solid, for the same-sized container, there is less liquid in a solid/liquid combination product than in an all-liquid product. Accordingly, not all of the contents of a solid/liquid combination product will function equally as a heat sink. As a result, the container of a solid/liquid combination product needs to have stronger material and/or more material than a comparable sized all-liquid container.

As mentioned above, the container of the invention includes a solid/liquid combination product, and in particular, a solid/liquid combination product that is a mostly non-liquid product. According to one embodiment of the invention, the solid/liquid combination product contains less than 85% liquid, which can vary in different embodiments. In one embodiment, the solid/liquid combination product contains between 1% and 30% liquid by volume, and preferably between 2% and 25% liquid by volume, and more preferably between 3% and 20% liquid by volume.

Figure 11:
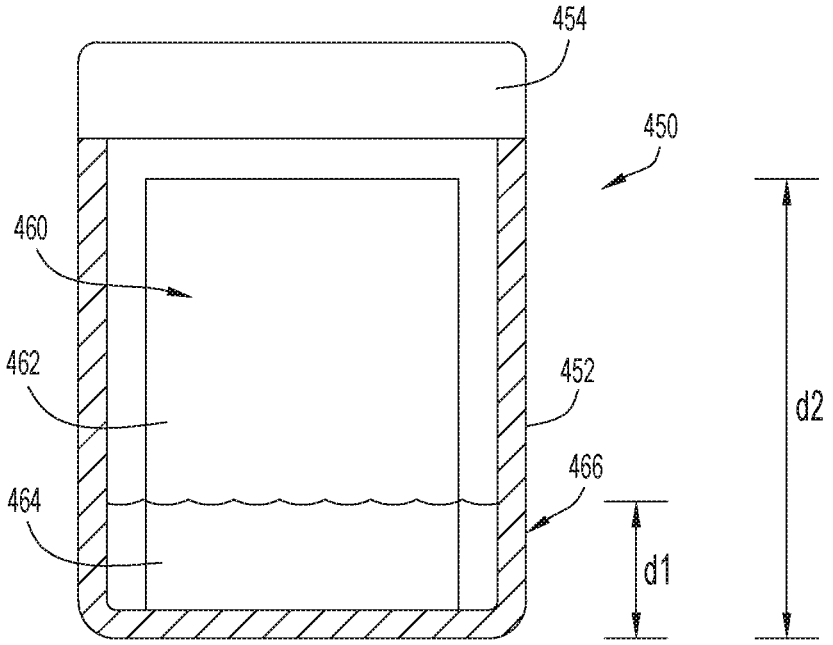
FIG. 11 is a partial cross-sectional view of a container showing a product in the container according to an embodiment of the invention.
Figure 12:
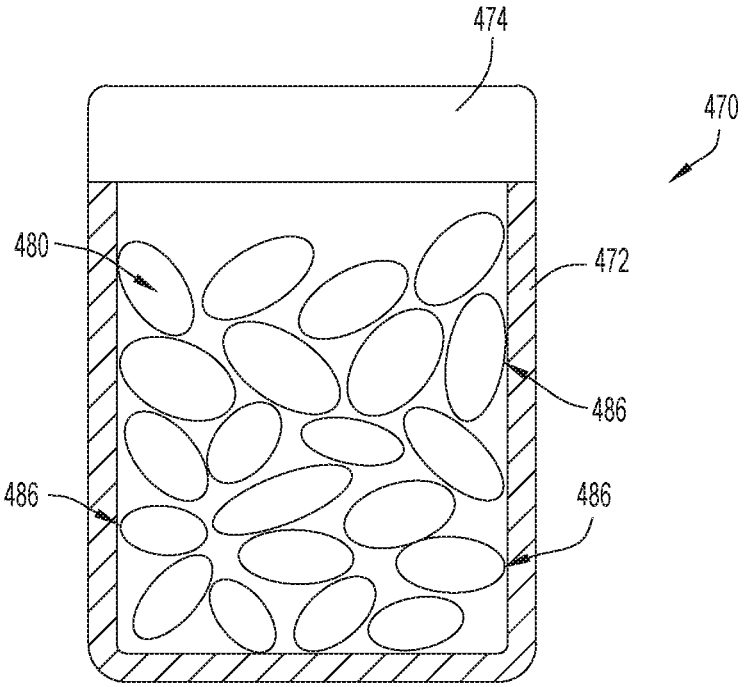
FIG. 12 is a partial cross-sectional view of a container showing a product in the container according to an embodiment of the invention.

Referring to FIGS. 11 and 12, two embodiments of containers and products according to the invention are illustrated. In FIG. 11, container 450 is illustrated with a container wall 452 and a lid 454 coupled thereto. The product 460 in the container 450 is a solid/liquid combination product that includes a solid portion 462 saturated with a liquid, such as a donut of wipes saturated with a sanitizing or disinfecting liquid. In one embodiment, the solid/liquid combination product has less than 85% liquid by volume, and accordingly, more than 15% solid by volume.

A portion of the liquid 464 of the product 460 is illustrated as being separated from the solid and in direct contact or engagement with the container wall 452 in area 466. This separated liquid can be referred to as a free liquid. The free liquid 464 is a heat sink that absorbs heat away from the wall 452, thereby reducing deformation. Noticeably, the contact of the free liquid 464 with container wall 452 is less (shown as length d1) than the full length of the container wall 452 (shown as length d2). By not having the full length d2 of container wall 452 being engaged with liquid 464, container 450 does not have the benefit of a full liquid heat sink that a bottle full of water or other liquid would have. Accordingly, the material of the container wall 452 will have to absorb and withstand more heat than a container full of liquid, which has more free liquid to be a larger heat sink. In one embodiment of the invention, the length d1 of the free liquid 464 is less than 20% of the full length d2. In another embodiment, the length d1 is less than 10% of the full length d2, and more preferably, less than 5% of the full length d2. In one embodiment, the free liquid 464 is at a level that is lower than the heel of the container, thereby not functioning as a heat sink for all of the heel of the container. As a result, the material used for the container body plays a larger role in minimizing deformation of the container when the liquid does not engage the heel.

Referring to FIG. 12, a different embodiment of a container and product according to the invention is illustrated. In this embodiment, container 470 is illustrated with a container wall 472 and a lid 474 coupled thereto. The product 480 in the container 470 is a solid product 480, such as a vitamin, mineral and/or supplement, alternatively, a laundry product such as scented beads. As illustrated, the container 470 contains several products 480 that are arranged inside of the container 470. Due to the solid nature of the product 480, there are spaces or air gaps between the products 480. Also, only certain products 480 are in contact or engagement with the container wall 472 at several spaced apart areas 486. The solid products do not absorb heat as efficiently as a liquid due in part to the gaps between the products and the container wall 472, and because the liquid product 464 is in full direct contact with the container wall 472. In one embodiment, the amount of contact between the product 480 and the container wall 472 is less than 20% of the full length of the wall 472, and preferably, less than 5% of the full length of the wall 472.

Figure 13:
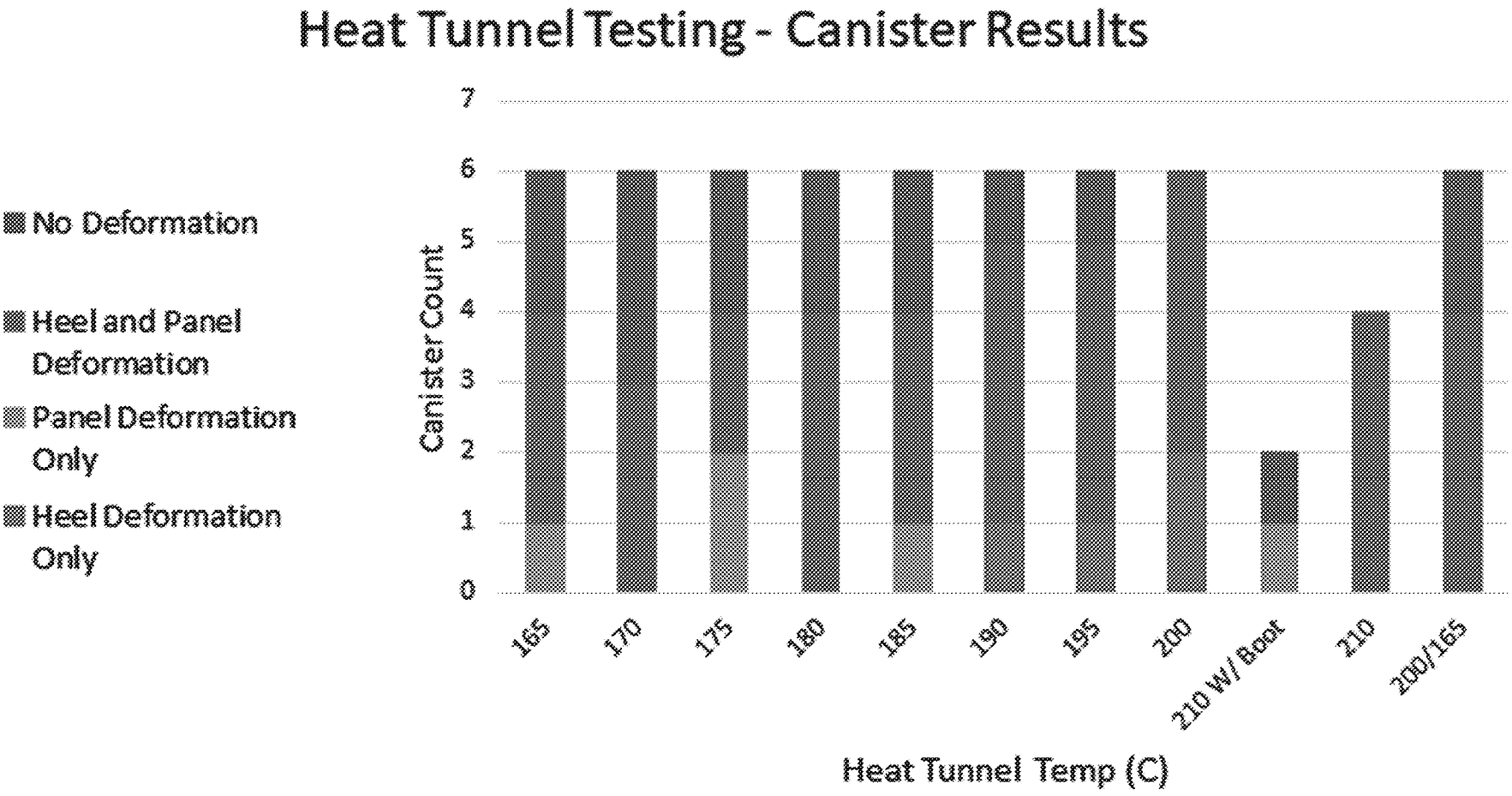
FIG. 13 is a chart illustrating testing done on containers according to the invention.

Referring to FIG. 13, a chart showing the results of testing of containers is illustrated. The containers were tested at different temperatures in the heat tunnel. At lower temperatures, the quantity of containers experiencing no deformation is larger than a higher temperatures. The testing included determining whether any deformation occurred in the heel and/or panel portions of the container. Six containers were tested at each of 165, 170, 175, 180, 185, 190, 195 and 200 degrees Celsius. Four containers were tested at 210 degrees Celsius, and only two containers were tested at 210 degrees Celsius using a boot, which is a tray forming a base or shield for the containers. Often, normal heat tunnel operations do not utilize a boot.

As shown in FIG. 13, the quantities of containers with no deformation were three at 170 degrees, two at each of 165, 175, 180, and 185 degrees, and one at each of 190, 195, and 210 (with a boot). Thus, as the temperature increased, the percentage of containers with no deformation decreased. Between 165 degrees and 210 degrees, several containers experienced deformation in both the heel and the panel portions. In particular, heel and panel deformation was seen as follows: three containers at each of 165, 170, and 185 degrees, two containers at 175 degrees, and four containers at each of 180, 190, 195, 200, and 210 degrees. Panel deformation only was seen in one container each at 165, 185, and 210 (with the boot) degrees, and in two containers at 175 degrees. Finally, heel deformation only was seen in one container each at 190 and 195 degrees, and in two container each at 200 degrees.

Referring to FIGS. 14-18, the varying of the thickness of the material of the side wall and the base of a container or canister according to the present invention is discussed. A minimum container wall thickness is required to minimize damage to the container through either or both the heat shrink tunnel process and any vertical loads being applied. The portion of the container illustrated in each of FIGS. 14-18 is part of the side wall and corresponding base of a container. The dimensions discussed relative to FIGS. 14-18 are from testing of different thickness containers, with the varying in thickness with a particular container occurring based on variability in the container formation process.

Figure 14:
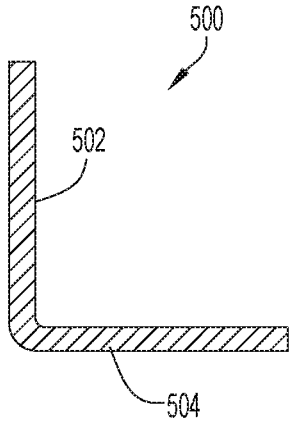
FIG. 14 is a side cross-sectional view of a portion of a side wall and a base of a conventional container.

Referring to FIG. 14, the illustrated portion of container 500 includes part of a side wall 502 and part of the base 504 of a standard dimension container. In particular, the minimum thickness of the side wall 502 and the base 504 is 0.009 inches and an average thickness of the side wall 502 and the base 504 is 0.011 inches.

Figure 15:
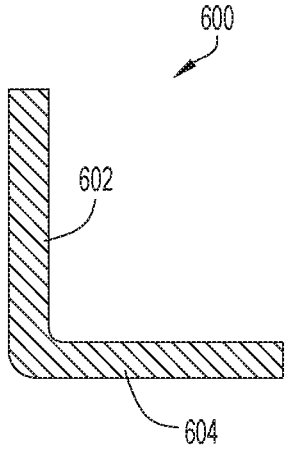
FIG. 15 is a side cross-sectional view of a portion of a modified side wall and base of a container according to the invention.

Referring to FIG. 15, a modification of the thickness of each of the container side wall and the container base according to the present invention is illustrated. Thin spots in either or both a container side wall or a container base were found to lead to more deformation. As a result, the present invention contemplates increasing the material thickness in certain areas of the side wall and the base of the container, particularly, in the base or heel. The increased thickness is greater than the minimum thickness of the container side wall or base.

The illustrated part of container 600 includes part of a side wall 602 and part of a base 604. In this embodiment, the material of each of the side wall 602 and the base 604 is thicker than the corresponding parts of container 500. In another embodiment, the increase in material is limited to the thin spots of the heel where deformation was occurring in the container during testing. By increasing the amount of plastic in the weak spots, thermal deformation of the container can be reduced or substantially minimized. In this embodiment, the minimum thickness of side wall 602 and base 604 is 0.013 inches, and the average thickness is 0.014 inches. Container 600 with side wall 602 and base 604 was able to withstand more weight (119 lbs vs. 105.5 lbs) than container 500 in a DVL test.

Figure 16:
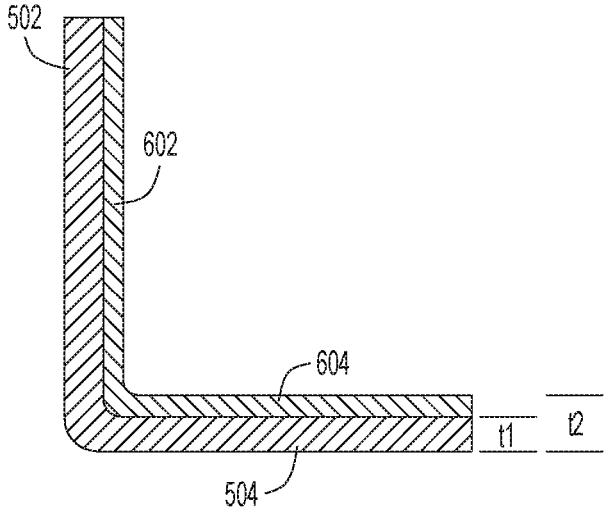
FIG. 16 is a side cross-sectional view of a comparison of the side walls and bases in FIGS. 14 and 15 showing the difference between them.

Referring to FIG. 16, a comparison of container 600 and container 500 is illustrated. As shown, the side wall 602 of container 600 is thicker than the side wall 502 of container 500. Similarly, the base 604 of container 600 is thicker than the base 504 of container 500. The thickness dimension "t1" represents the thickness of the side wall 502 and the base 504 of container 500. The thickness dimension "t2" represents the thickness of the side wall 602 and the base 604 of container 600. As illustrated, thickness "t2" is greater than thickness "t1". This increased thickness of container 600 strengthens it relative to container 500.

Figure 17:
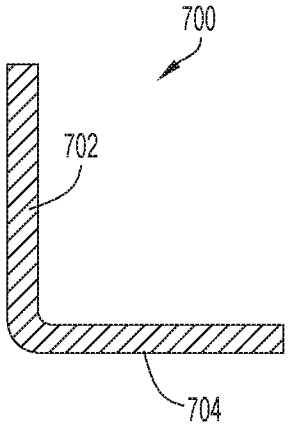
FIG. 17 is a side cross-sectional view of a portion of another modified side wall of a container according to the invention.

Referring to FIG. 17, another modification of the thickness of the side wall and base of a container according to the present invention is illustrated. The illustrated part of container 700 includes part of a side wall 702 and part of a base 704. In one embodiment, the minimum thickness of the side wall 702 and the base 704 is 0.011 inches, and the average thickness of them is 0.012 inches. Container 700 was able to withstand slightly more weight (106 lbs vs. 105.5 lbs) than container 500 in a DVL test.

Figure 18:
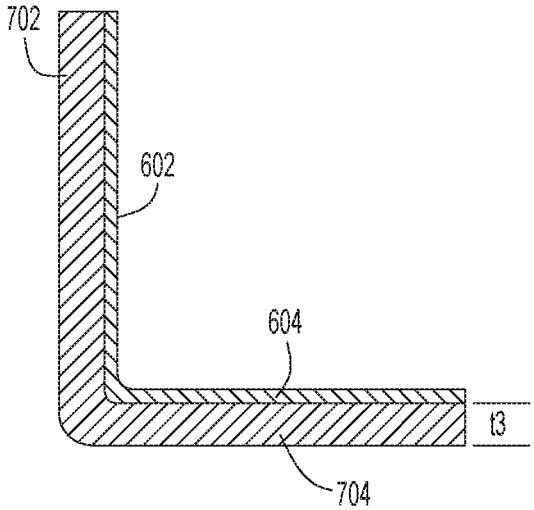
FIG. 18 is a side cross-sectional view of a comparison of the side walls and bases in FIGS. 15 and 17 showing the difference between them.

Referring to FIG. 18, a comparison of container 600 and container 700 is illustrated. As shown, the thickness dimension "t3" represents the thickness of the side wall 702 and the base 704 of container 700. While thickness "t3" is less than thickness "t2", thickness "t3" is larger than the thickness "t1" of container 500. This increased thickness of container 700 strengthens it relevant to container 500.

Figure 19:
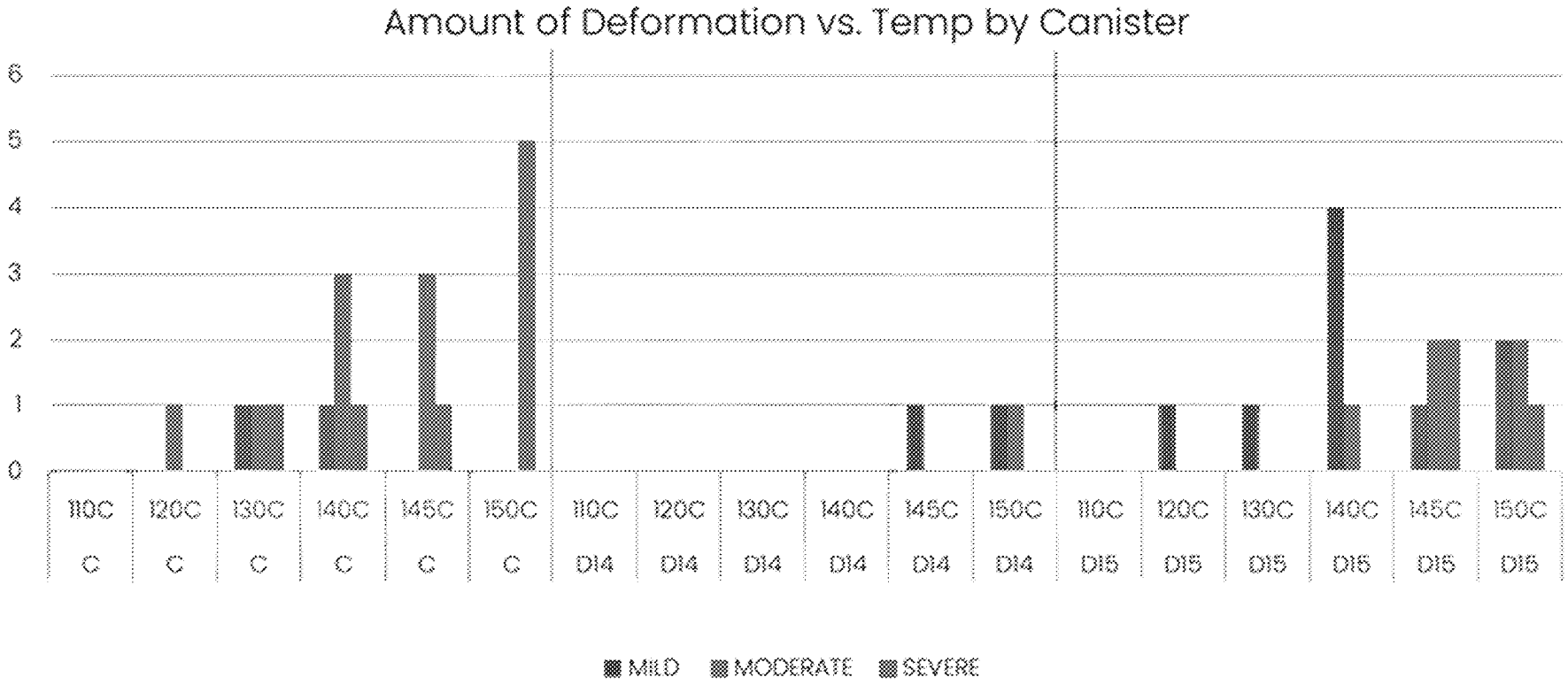
FIG. 19 is a chart illustrating testing done on containers according to the invention.

Referring to FIG. 19, three charts showing the container deformation by temperature are illustrated side by side. Each chart uses a vertical axis that denotes the quantity of containers and has graphed bars representing the types of deformation, which are mild, moderate, and severe. The tested containers had side walls with dimensions as discussed above relative to FIGS. 14, 15, and 17. Five containers of each container type were tested at the various temperatures as described below.

Referring to the first graph on the left, conventional containers with the dimensions discussed relative to FIG. 14 were tested. At 110 degrees Celsius, no containers 500 experienced any deformation. At 120 C, one container experienced mild deformation. At 130 C, three containers experienced deformation, with one at each of the three deformation types: mild, moderate and severe. At 140 C, all five containers experienced deformation with three being moderate, and one each being mild or severe. At 145 C, four containers experienced deformation with three being moderate and one being severe. At 150 C, all five containers experience severe deformation.

Referring to the middle graph, containers with the dimensions discussed relative to FIG. 15 were tested. No containers 600 experienced any deformation at 110 C, 120 C, 130 C, or 140 C. At 145 C, one container mild experienced deformation. At 150 C, one container experienced mild deformation and one container experienced moderate deformation. As can be seen in FIG. 19, containers 600 experienced much less deformation than containers 500 when subjected to the same heat temperatures.

Referring to the graph on the right, containers with the dimensions discussed relative to FIG. 17 were tested. At 110 C, no containers 700 experienced any deformation. At each of 120 C and 130 C, only one container experienced mild deformation. At 140 C, all containers experienced deformation, with four having mild deformation and one having moderate deformation. At 145 C, all five containers experienced deformation with one being mild, two being moderate, and two being severe. Finally, at 150 C, all five containers experienced deformation with two being mild, two being moderate, and one being severe. Collectively, the containers 700 experienced less deformation than containers 500, but more deformation than containers 600.

Adding extra plastic material in the container areas susceptible to deformation during the heat shrink process, such as the heel of each container, reduces the overall deformation of the container, which results in a stronger container. A stronger container can withstand increased loads and will last longer in shipping and storage activities. In addition, the stronger container design due to increased thickness in select areas will allow more additive material, including PCR material, to be used in the product, thereby reducing the amount of single-use plastic used in the containers.

In one embodiment of the present invention, the minimum thickness of the side walls of a container is less than 0.1 inches. In other embodiments of the present invention, the minimum thickness of the container side walls is between 0.003 inches and 0.09 inches, and preferably between 0.005 inches and 0.02 inches. In yet another embodiment of the invention, the minimum thickness of the container side walls is between 0.01 inches and 0.02 inches.

Like numbers refer to like elements throughout. The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

It will also be understood that, as used herein, the terms "example," "exemplary," and derivatives thereof are intended to refer to non-limiting examples and/or variants embodiments discussed herein, and are not intended to indicate preference for one or more embodiments discussed herein compared to one or more other embodiments.

The term "comprising" which is synonymous with "including," "containing," or "characterized by," is inclusive or open-ended and does not exclude additional, unrecited elements or method steps. The term "consisting essentially of" limits the scope of a claim to the specified materials or steps "and those that do not materially affect the basic and novel characteristic(s)" of the claimed invention. The term "consisting of" as used herein, excludes any element, step, or ingredient not specified in the claim.

All publications, patents and patent applications cited herein, whether supra or infra, are hereby incorporated by reference in their entirety to the same extent as if each individual publication, patent or patent application was specifically and individually indicated to be incorporated by reference.

The invention being thus described, it will be apparent that the same may be varied in many ways. Such variations are not to be regarded as a departure from the spirit and scope of the invention, and all such modifications as would be obvious to one skilled in the art are to be included within the scope of the following claims.

The invention claimed is:

1. A packaged product, comprising:

a first container and a second container, each of the first container and the second container having a side wall, the first container being made of polyethylene terephthalate (PET) and having a minimum wall thickness between 0.003 inches and 0.09 inches, the first container having a product therein, the product in the first container including free liquid within the first container, the free liquid directly engaging less than 5% of a length of the side wall of the first container; and a plastic film coupling the first container and the second container together, wherein heat energy is applied to the plastic film to couple it to the first container and the second container.

2. The packaged product of claim 1, wherein the minimum wall thickness of the first container is between 0.005 inches and 0.02 inches.

3. The packaged product of claim 2, wherein the minimum wall thickness of the first container is between 0.009 inches and 0.02 inches.

4. The packaged product of claim 3, wherein the minimum wall thickness of the first container is between 0.01 inches and 0.02 inches.

5. The packaged product of claim 1, wherein the first container has at least 25% of its material being additive material, and the additive material includes post-consumer recycled (PCR) material, colorants and/or strengthening agents.

6. The packaged product of claim 1, wherein the product in the first container is a solid/liquid combination product that has less than 85% liquid by volume.

7. The packaged product of claim 6, wherein the solid/liquid combination product includes substrates and an aqueous solution saturating at least part of the substrates, the aqueous solution being one of a sanitizing liquid or a disinfecting liquid.

8. The packaged product of claim 1, wherein the product in the first container includes a solid product.

9. The packaged product of claim 1, further comprising:

a tray disposed between a portion of each of the first container and the second container and the plastic film.

10. A product, comprising:

a plurality of containers, each of the containers having a minimum wall thickness between 0.003 inches and 0.09 inches, each of the containers being made of PET and having a product therein with at least a portion of the product in direct contact with a portion of a side wall for the container, the product in each container directly engaging less than 5% of a length of the side wall of that container; and a coupler activatable by heat energy to shrink around portions of the plurality of containers, wherein heat energy is applied to the coupler so that it shrinks.

11. The product of claim 10, wherein the minimum wall thickness of a first container of the plurality of containers is between 0.005 inches and 0.02 inches.

12. The product of claim 10, wherein a container of the plurality of containers has at least 25% of its material being additive material, and the additive material includes PCR material, colorants and/or strengthening agents.

13. The product of claim 10, wherein the product in each container is a solid/liquid combination product that has less than 85% liquid by volume.

14. The product of claim 13, wherein the solid/liquid combination product includes substrates and an aqueous solution saturating at least part of the substrates, the aqueous solution being one of a sanitizing liquid or a disinfecting liquid.

15. The product of claim 10, wherein the product in each container includes a solid product.

16. A packaged product, comprising:

a first container having a first side wall with a first length extending from an upper end to a lower end, the first container being made of polyethylene terephthalate (PET) and having a minimum wall thickness between 0.003 inches and 0.09 inches, the first container having a first product therein, the first product including a free liquid that engages less than 20% of the first length of the first container;

a second container having a second side wall with a second length extending from an upper end to a lower end, the second container being made of PET and having a minimum wall thickness between 0.003 inches and 0.09 inches, the second container having a second product therein, the second product including a free liquid that engages less than 20% of the second length of the second container; and a plastic film coupling the first container and the second container together, wherein heat energy is applied to the plastic film to couple it to the first container and the second container.

17. The packaged product of claim 16, wherein the minimum wall thickness for each of the first container and the second container is between 0.005 inches and 0.02 inches.

18. The packaged product of claim 16, wherein the free liquid in the first container engages less than 5% of the first length of the first container, and the free liquid in the second container engages less than 5% of the second length of the second container.

19. The packaged product of claim 16, wherein the product in the first container is a solid/liquid combination product that has less than 85% liquid by volume.

20. The packaged product of claim 19, wherein the solid/liquid combination product includes substrates and an aqueous solution saturating at least part of the substrates, the aqueous solution being one of a sanitizing liquid or a disinfecting liquid.

* * * * *